United States Patent [19]

Kendrick

[11] 3,988,998

[45] Nov. 2, 1976

[54] BOAT ANCHORING DEVICE

[76] Inventor: Hardy Louis Kendrick, Star Rte., Box 12, Jena, La. 71342

[22] Filed: Mar. 1, 1976

[21] Appl. No.: 662,441

[52] U.S. Cl. ..... 114/230
[51] Int. Cl.[2] ..... B63B 21/00
[58] Field of Search..... 114/230, 206 R; 61/48, 61/52, 53; 52/155, 158

[56] References Cited

UNITED STATES PATENTS

| | | | |
|---|---|---|---|
| 3,063,402 | 11/1962 | Vallquist | 114/230 |
| 3,571,836 | 3/1971 | Dunlap | 114/230 |

*Primary Examiner*—Trygve M. Blix
*Assistant Examiner*—Stuart M. Goldstein
*Attorney, Agent, or Firm*—Roy, Kiesel, Patterson, Hudson & Abadie

[57] ABSTRACT

An anchoring device for small boats which can be easily secured to the water bank is provided comprising two arms attached together at one of their ends at an angle of approximately 90°, one arm being longer than the other arm and each arm having a pointed end. A rope attaching device is slidably mounted to one arm of the anchoring device and moves up and down the arm as the water level rises or drops.

7 Claims, 3 Drawing Figures

BOAT ANCHORING DEVICE

BACKGROUND OF THE INVENTION

1. Field of the Invention

This invention relates generally to anchoring devices and more particularly, to anchoring devices used to secure a boat to a river bank.

2. Prior Art

River fishing is a highly popular sport in the United States. In this sport, the fisherman will travel up and down the river during the course of his fishing, tying up to the river bank many times. Because of the soft banks, swift current and/or change in river level, many problems occur in quickly securing the boat at any one spot on the river bank. Other problems occur while freeing the boat from the river bank when the fisherman desires to change fishing locations.

SUMMARY OF THE INVENTION

One object of this invention is to provide a boat anchoring device that can be securely attached to a river bank without the boat operator leaving the boat.

Another object of this invention is to provide a boat anchoring device that can quickly be attached to a river bank.

Still another object of this invention is to provide a boat anchoring device that can be used effectively on river banks where the river level is rising or falling rapidly.

A further object of this invention is to provide a boat anchoring device that can be used on a river bank that can be composed either of hard or soft ground.

Accordingly, a boat anchoring device is provided having two arms attached together at one of their ends at an angle of 90° or less, with one arm being longer than the other and each arm having their other end pointed. The device also has a boat connecting assembly fixedly attached at one end to the arms and having a ring link at the other end mounted about the longer arm wherein the ring link at the other end mounted about the longer arm, wherein the ring link has a hollow center of sufficient diameter to slide up and down the longer arm. The assembly will also have a means to attach to the boat.

PREFERRED EMBODIMENTS OF THIS INVENTION

Figure 1:
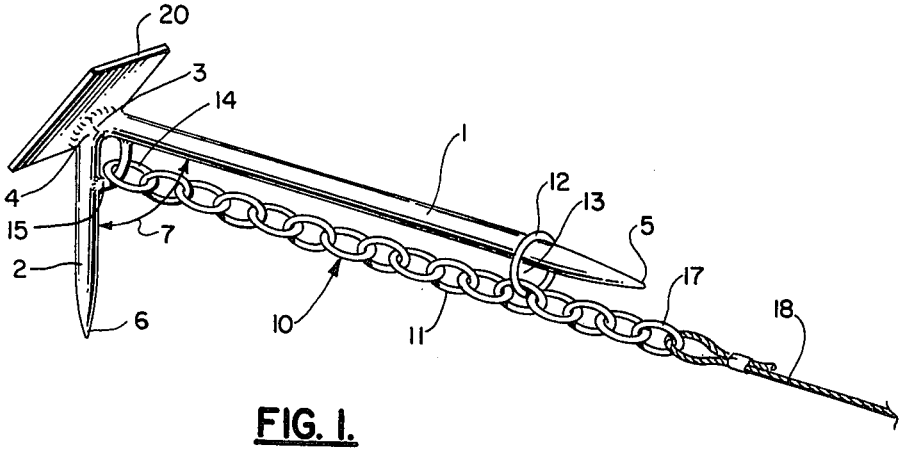
FIG. 1 is a perspective view of one embodiment of the anchoring of this invention.

The anchoring device has arm 1 and arm 2 attached together at their ends 3 and 4, respectively. The other ends 5 and 6, respectively, are pointed. In a preferred feature, arms 1 and 2 could be formed by bending a single metal rod. In another embodiment, arms 1 and 2 could be molded. Regardless of how arms 1 and 2 are formed, the angle 7 between them should be 90° or less in order that the anchoring device could be secured to river bank 8 by the board operator while still in the boat.

In a preferred feature, boat connecting assembly 10 will be a piece of chain 11 having an end link 12 that fits about arm 1 and whose cavity 13 is of sufficient diameter to slide up and down arm 1. In a preferred feature, link 14 at the other end of chain 11 is connected to rod member 15 which is attached to arms 1 and 2 in the area formed by angle 7. Preferably, chain 11 is of short enough length that when extended along arm 1 link 12 cannot slip off end 5. Boat 16 is then attached to another link 17 of chain 11 by line 18 which is secured at its other end 19 to boat 16 in a conventional manner. In another preferred feature, pressure plate 20 is attached to arms 1 and 2 at a point where their ends 3 and 4, respectively, connect and which is attached opposite angle 7.

The anchoring device of this invention is very versatile. If the boat is to be anchored to a river bank for only a short period of time, and the river level will not change appreciably during this time, then the device can be used as shown in FIG. 1.

In this embodiment it is preferred that line 18 be connected to the mid-section of the boat with line 18 being kept as short as possible. This will increase the stabilization of the boat while being anchored.

The boat operator merely guides boat 17 to the river bank and while holding arm 1 near end 5 strikes bank 8 with pointed end 6 of arm 2. In this embodiment, it is preferred that arm 1 be at least twice as long as arm 2 for better leverage.

Figure 2:
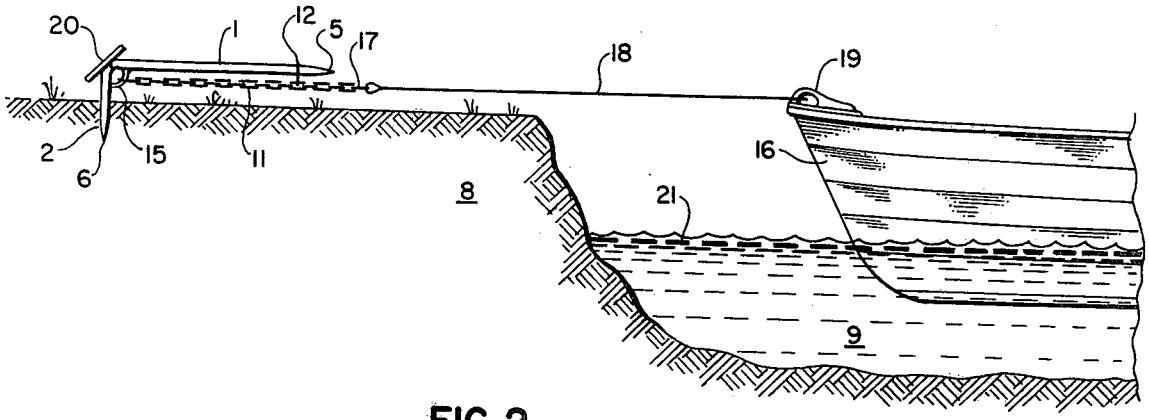
FIG. 2 is a perspective view of the anchoring device of this invention used in one position to hold a boat to a bank of a river.
Figure 3:
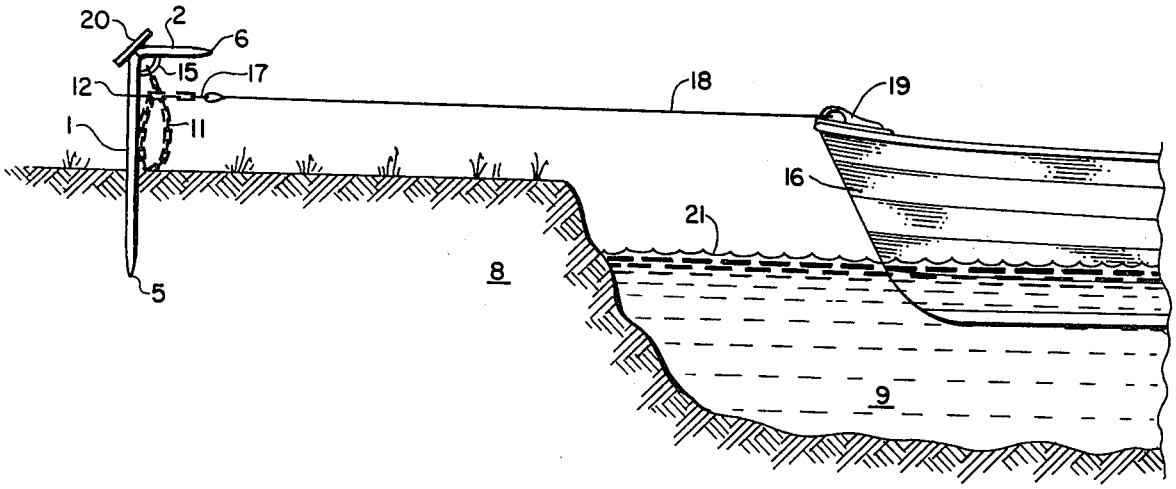
FIG. 3 is another perspective view of the anchoring device of this invention used in a second position to hold a boat to a bank of a river.

Now, if river level 21 is rising or falling rapidly, or if river bank 8 is very soft or marshy, then the anchor device is used as shown in FIG. 2. In this embodiment, a greater length of arm can be pushed in river bank 8. Also, chain 11 will allow link 12 to slide down arm 1 until line 18 is horizontal to water level 21. Line 18 will remain horizontal to water level 21 even if water level 21 rises or falls. The importance of this feature is less lifting force is exerted by the boat against the anchoring device.

The anchor device can also be used to secure boat 16 to bank 7 for long periods of time or in very hard ground. In this embodiment, the boat operator may need to use pressure plate 20 by pushing down on it with his foot.

There are, of course, many obvious alternate embodiments not specifically mentioned herein which are within the scope of this invention.

What I claim is:

1. A boat anchoring device that can be used to secure a boat to a river bank, comprising:

a. two arms attached together at one of their ends at an angle of 90° or less, one arm being longer than said other arm, each arm having its other end shaped to a point; and b. a boat connecting assembly fixedly attached at one end to said arms, said assembly comprising:

i. a ring link, said link mounted about said longer arm, said link having a hollow center of sufficient diameter to slide up and down said longer arm, and ii. a means attached to said link and to said arms and also being attached to said boat.

2. A boat anchoring device according to claim 1 wherein said long arm is at least twice as long as said short arm.

3. A boat anchoring device according to claim 1 wherein said device also comprises a pressure plate attached at a point where said arms join and attach opposite said angle.

4. A boat anchoring device according to claim 1 wherein said arms are formed from a bent metal rod.

5. A boat anchoring device according to claim 1 wherein said means comprises a chain with one of its loops being attached to said link.

6. A boat anchoring device according to claim 5 wherein said chain is attached to a rod by said chain's other end loop, said rod being attached to and between said arms in an area of said angle.

7. A boat anchoring device according to claim 2 wherein said chain is of short enough length that said link cannot slip off said long arm's pointed end.

* * * * *